United States Patent [19]

Antlfinger

[11] 4,374,894

[45] Feb. 22, 1983

[54] POLYOLEFIN NONWOVENS WITH HIGH WET STRENGTH RETENTION BONDED WITH VINYL CHLORIDE COPOLYMERS

[75] Inventor: George J. Antlfinger, Avon Lake, Ohio

[73] Assignee: The B F Goodrich Company, Akron, Ohio

[21] Appl. No.: 202,994

[22] Filed: Nov. 3, 1980

[51] Int. Cl.[3] ..... B32B 27/30; B32B 27/32; D04H 1/64; D04H 1/72

[52] U.S. Cl. ..... 428/288; 428/290; 428/518

[58] Field of Search ..... 428/288, 290, 518

[56] References Cited

U.S. PATENT DOCUMENTS 3,459,631 8/1969 Hamilton et al. .
3,922,424 11/1975 Andersen ..... 428/264

OTHER PUBLICATIONS

Chem. Abst. 66-96103.
Chem. Abst. 68-14049.
Chem. Abst. 72-68119.
Chem. Abst. 73-78403.
Chem. Abst. 73-99974.
Chem. Abst. 82-59666.
Chem. Abst. 83-44697.
Chem. Abst. 94-17019.

*Primary Examiner*—James C. Cannon
*Attorney, Agent, or Firm*—George A. Kap

[57] ABSTRACT

A polyolefin fabric, such as polyethylene or polypropylene, having improved wet tensile strength retention is made by bonding polyolefin fibers with a latex containing at least 5% polyvinyl chloride and/or polyvinylidene chloride.

5 Claims, No Drawings

POLYOLEFIN NONWOVENS WITH HIGH WET STRENGTH RETENTION BONDED WITH VINYL CHLORIDE COPOLYMERS

BACKGROUND OF THE INVENTION

A nonwoven fabric is a textile structure consisting of a mat of fibers held together with a bonding material. The fibers can be partially oriented or they can be completely randomly distributed. Latex is often used as the binder for the fibers in nonwoven fabrics.

Nonwoven fabrics are popular owing to the simplicity and economy of their production since the traditional weaving operations are not used; hence, less equipment, less space, and fewer personnel are required. Nonwoven fabrics can also be produced from what would normally be considered as waste fibers, and useful characteristics are obtained which may not be provided by woven or knitted fabrics.

Enormous quantity of fibers are consumed annually in applications of nonwoven fabrics such as clothing interliners, filters, automotive door panels, heat and electrical insulation, packaging, sanitary napkins, fillers for quilted structures, wiping cloths, towels, masks, wall coverings, shoe uppers and liners, curtains and draperies, tea bags, simulated leather, gaskets, luggage, ribbons, and diapers.

Conventional carding equipment used in the weaving industry can produce fiber webs of uniform thickness suitable for impregnation with a binder, but it has one drawback: while lengthwise strength is usually good, cross-direction strength is generally poor owing to the staple fibers being laid lengthwise of the fabric or in the machine direction of the material.

To obtain a nonwoven fabric with substantially uniform strength in all directions, random distribution of the fibers has been achieved by several methods. One of the most popular of such methods involves air-laying of the fibers by stripping same from a carded web by means of an air stream which then directs the fibers through a restricting throat which is controlled to adjust the thickness of the resulting web.

A number of methods have been developed for treating randomly-dispersed webs with a binder. Typically, a water-based emulsion binder system is used in which a thermoplastic or thermoset synthetic polymer latex is prepared and a loose web of fibers to be treated is immersed therein using special equipment in view of the structural weakness of the web. The treated web is then dried and cured to effect proper bonding. Alternatively, an aqueous or solvent solution binder system of a thermoplastic or thermoset resin may be used to impregnate the fibrous web.

Still other methods include the application of thermoplastic or thermoset resin powders to the fibers, before or after making a web of same, and passing the web through hot rolls or a hot press to bind the fibers together. Alternatively, thermoplastic fibers having a softening point below that of the base fibers may be interspersed in a web of the latter and sufficient heat and pressure applied, such as by the use of heated rolls, to soften the thermoplastic fibers and bind the fiber network together.

Commonly used latexes for nonwoven fabrics are those prepared from polymers of butadiene-stryene, butadiene-acrylonitrile, vinyl acetate, and acrylic monomers. While the emulsion binder system using latexes is the most popular method of forming nonwoven abrics, the homopolymers, copolymers and terpolymers heretofore used have suffered from shortcomings. Since, for example, the end uses to which the nonwoven fabrics are applied play a major role in determining what polymeric binder is used, it can readily be appreciated that the properties of the polymeric binder are critical.

While the acrylic polymer latexes are presently enjoying significant success due to the fact that nonwoven fabrics bonded therewith are generally soft and have a good hand, they have certain drawbacks, chief among which are cost and wet strength retention. Presently, acrylic latexes are considerably more expensive than the other common latexes and they do not have the desired wet tensile strength which is of paramount importance in applications such as diapers, wiping cloths, mops, shoe innersoles, etc.

SUMMARY OF THE INVENTION

This invention relates to polyolefin nonwoven fabrics bonded with polymers containing polyvinyl chloride and/or polyvinylidene chloride and to a method for preparing such bonded fabrics which have unexpectedly better wet tensile strength retention. More particularly, the instant discovery concerns the use of latexes containing polyvinyl chloride to bond thin polyolefin nonwoven fabrics in order to achieve an impressive and unexpected improvement in the wet tensile strength retention.

DETAILED DESCRIPTION OF THE INVENTION

Suitable polymer latexes for bonding polyolefin fibers include those that are selected from homopolymers of vinyl chloride or vinylidene chloride and latexes wherein vinyl chloride and/or vinylidene chloride are polymerized with other monomers. Amount of polyvinyl chloride and/or polyvinylidene chloride in such latexes can vary from 5% and up to 100%, preferably a minimum of 20%. Copolymer latexes are made from vinyl and/or vinylidene halides, such as vinyl chloride and vinylidene chloride, copolymerized with one or more of comonomers such as $\alpha,\beta$-olefinically unsaturated carboxylic acids containing 3 to 5 carbon atoms, such as acrylic, methacrylic, ethacrylic and cyanoacrylic acids; monounsaturated dicarboxylic acids containing 4 to 8 carbon atoms, such as fumaric and maleic acids; esters of $\alpha$, $\beta$-olefinically unsaturated carboxylic acids containing 3 to 5 carbon atoms and monounsaturated dicarboxylic acids containing 4 to 20 but preferably 4 to 12 carbon atoms, such as methyl acrylate, ethyl acrylate, butyl acrylate, 2-ethylhexyl acrylate, octyl acrylate, ethyleneglycol dimethacrylate, diethylene glycol diacrylate, cyanoethyl acrylate, methyl methacrylate, butyl methacrylate, hydroxypropyl methacrylate, ethyl maleate, butyl fumarate, maleic dimethyl ester, maleic acid mono-(2-ethylhexyl)ester, fumaric acid diethyl ester, and fumaric acid dilauryl ester; $\alpha$, $\beta$-olefinically unsaturated nitriles containing 3 to 5 carbon atoms, such as acrylonitrile and methacrylonitrile; acrylamides derived from acrylic and methacrylic acids and their N-alkylol and N-alkoxyalkyl derivatives containing 3 to 20 but preferably 3 to 12 carbon atoms, such as acrylamide itself, N-methylol acrylamide, N-butoxy methacrylamide, methylenebisacrylamide, methacrylamide, N-octyl acrylamide, diacetone acrylamide, and hydroxymethyl diacetone acrylamide; vinyl ethers containing 4 to 22 crbon atoms, such as ethyl vinyl ether, chloroethyl vinyl ether, isobutyl vinyl ether, cetyl vinyl ether, and lauryl vinyl ether; vinyl ketones containing 3 to 12 carbon atoms, such as methyl vinyl ketone; vinyl esters of carboxylic acids containing 4 to 22 carbon atoms, such as vinyl acetate, vinyl propionate, vinyl formate, vinyl stearate, vinyl benzoate, and vinyl and allyl chloroacetate; α-olefins containing 2 to 12 carbon atoms, such as ethylene, propylene, isobutylene, and butene-1; styrene and styrene derivatives such as α-methyl styrene, vinyl toluene, and chlorostyrene; and other polyfunctional monomers such as vinyl naphthalene, vinyl pyridine, divinyl benzene, and allyl pentaerythritol.

The term "latexes containing polyvinyl chloride and/or polyvinylidene chloride" includes latexes of vinyl chloride and vinylidene chloride homopolymers and copolymers thereof with copolymerizable monomers.

Preferred latexes are prepared by emulsion polymerization of vinyl chloride and one or more comonomers. Comonomers for the preferred latexes include acrylic and methacrylic acids and alkyl esters derived therefrom which contain 1 to 20 carbon atoms, preferably 2 to 12, in the alkyl group; amides derived from α,β-olefinically unsaturated carboxylic acids and their N-alkylol and N-alkoxyalkyl derivatives such as acrylamide, N-octyl acrylamide, and hydroxymethyl diacetone acrylamide; and vinylidene halides, such as vinylidene chloride. Specific examples of preferred latexes containing polyvinyl chloride are copolymers of the following monomers: vinyl chloride, 2-ethylhexyl acrylate, vinylidene chloride, and acrylic acid; vinyl chloride, 2-ethylhexyl acrylate, vinylidene chloride, and hydroxymethyl diacetone acrylamide; vinyl chloride and methyl acrylate; vinyl chloride, butyl acrylate, acrylic acid, and N-methylol acrylamide; and vinyl chloride, 2-ethylhexyl acrylate, vinylidene chloride, and hydroxypropyl methacrylate. The latexes can be plasticized or unplasticized.

The polymer latices embodied herein are prepared employing conventional polymerization techniques preferably in an aqueous medium with a suitable polymerization catalyst. Overpolymerization of the monomers may also be employed. Aqueous dispersions of solution polymers may be used.

The aqueous medium may be emulsifier-free or it may contain an emulsifier. When emulsifiers are used to prepare the latices of this invention, the usual types of anionic and non-ionic emulsifiers will be employed. Useful anionic emulsifiers include alkali metal or ammonium salts of the sulfates of alcohols having from 8 to 18 carbon atoms such as sodium lauryl sulfate; ethanolamine lauryl sulfate, ethylamine lauryl sulfate; alkali metal and ammonium salts of sulfonated petroleum and paraffin oils; sodium salts of sulfonic acids such as dodecane-1-sulfonic acid and octadiene-1-sulfonic acid; aralkyl sulfonates such as sodium isopropyl benzene sulfonate, sodium dodecyl benzene sulfonate and sodium isobutyl naphthalene sulfonate; alkali metal and ammonium salts of sulfonated dicarboxylic acid esters such as sodium dioctyl sulfosuccinate, disodium-n-octadecyl sulfosuccinamate; alkali metal or ammonium salts of the free acid of complex organic mono- and diphosphate esters; and the like. Non-ionic emulsifiers such as octyl- or nonylphenyl polyethoxyethanol may also be used. Latices having excellent stability are obtained with the alkali metal and ammonium salts of aromatic sulfonic acids, aralkyl sulfonates, long chain alkyl sulfonates and poly(oxyalkylene)sulfonates.

If an emulsifier is used, this may range up to about 6% or more by weight based on the monomers, but it preferably is less than 6%, and excellent results have been obtained with less than 1%. The emulsifier may be entirely added at the outset of the polymerization or it may be added incrementally or by proportioning throughout the run. Typically, a substantial amount of the emulsifier is added at the outset of the polymerization and the remainder charged incrementally or proportionately to the reactor as the monomers are proportioned.

The polymerization may be conducted at temperatures from about 0° C. or less to about 100° C. in the presence of a compound capable of initiating the polymerizations. Commonly used free radical initiators include the various peroxygen compounds such as persulfate, benzoyl peroxide, t-butyl hydroperoxide, cumene hydroperoxide, t-butyl diperphthalate, pelargonyl peroxide and 1-hydroxycyclohexyl hydroperoxide; azo compounds such as azodiisobutyronitrile and dimethylazodiisobutyrate; and the like. Particularly useful initiators are the water-soluble peroxygen compounds such as hydrogen peroxide and the sodium, potassium and ammonium persulfates used by themselves or in an activated redox system. Typical redox systems include alkali metal persulfates in combination with a reducing substance such as polyhydroxyphenols and oxidizable sulfur compounds such as sodium sulfite or sodium bisulfide, a reducing sugar, dimethylamino propionitrile, a diazomercapto compound and a water-soluble ferricyanide compound, or the like. Heavy metal ions may also be used to activate the persulfate catalyzed polymerization. Polymer latices having excellent stability are obtained with alkali metal and ammonium persulfate polymerizations. The amount of initiator used will generally be in the range between about 0.1% to 3% by weight based on the total monomers and preferably is between about 0.15% and 1% by weight. The initiator may be charged completely at the outset of the polymerization, however, incremental addition or proportioning of the initiator throughout the polymerization may also be employed and is often advantageous.

Typical polymerizations for the preparation of the low-temperature curable polymer latices are conducted by charging the reactor with the appropriate amount of water and electrolyte, if any is to be employed, a portion of the emulsifier, if any, and a portion of the initiator sufficient to initiate the polymerization. The reactor is then evacuated, heated to the initiation temperature and charged with a portion of the monomer premix which is previously prepared by mixing water, emulsifier, the monomers and polymerization modifiers, if any are employed. After the initial monomer charge has been allowed to react for a period of time the proportioning of the remaining monomer premix is begun, the rate of proportioning being varied depending on the polymerization temperature, the particular initiator employed and the amount of vinylidene halide monomer being polymerized. After all the monomer premix has been charged the final addition of initiator is made and the reactor and the latex heated with agitation for a length of time necessary to achieve the desired conversion.

Excellent results have generally been obtained with those latices containing small amounts of emulsifiers, soaps, suspending agents or dispersants, for example, with latices prepared with less than about 2% of emulsifier, soap, and the like. Acceptable emulsifier-free latices have been prepared with substantially water-soluble monomers such as ethyl acrylate and acrylic acid, often with small amounts of acrylonitrile and acrylamide that do not require any emulsifier. Many latices having poor stability when mixed with the cement may be satisfactory when there is added thereto small amounts of nonionic emulsifying agents as 0.1 to 10 weight percent so as to stabilize the latex to extend the working time of the composition.

In the latex, the particle size may be in the range of about 1000 A. A generally satisfactory particle size may be, however, from about 500 to about 5000 A. The total solids of the latices may be varied widely and may relate to the fluidity wanted in the composition. 10% total solids latex providing more water, if desired, than 50 or 65% total solids latex.

Latexes suitable for the use described herein must be film formers. This is easily determined by placing a latex in an oven and drying it to see whether a film or a powder resin is formed. Film forming latexes from a powder resin type latex by the above test can be made by uniformly blending with the latex about 10 to 100 parts by weight of one or more plasticizers per 100 parts by weight of the resin. The useful plasticizers may be described as the alkyl and alkoxy alkyl esters of dicarboxylic acids or the esters of a polyhydric alcohol and a monobasic acid. As examples of such materials, there may be named dibutyl phthalate, dioctyl phthalate, dibutyl sebacate, dinonyl phthalate, di(2-ethyl hexyl)phthalate, di(2-ethyl hexyl)adipate, dilauryl phthalate, dimethyl tetrachlorophthalate, butyl phthalyl butyl glycollate, glyceryl stearate, and the like. The preferred plasticizers are the liquid diesters of aliphatic alcohols having from 4 to 20 carbon atoms and dibasic carboxylic acids having from 6 to 14 carbon atoms.

A suitable latex that can be prepared as described herein, has the following formulation, in parts by weight:

| | |
|---|---|
| demineralized water | 72 |
| vinyl chloride | 80 |
| methyl acrylate | 20 |
| sodium persulfate | 0.2 |
| tetrasodium pyrophosphate | 0.7 |
| sodium succinate | 1 |
| sodium alpha olefin sulfonate | 1 |
| ammonia | 0.5 |

The latexes containing polymerized vinyl halide and/or vinylidene halide may be compounded with, or have mixed therein, other known ingredients, such as fillers, plasticizers, antioxidants or stabilizers, antifoaming agents, dyeing adjuvants, pigments, or other compounding aids. Furthermore, thickeners or bodying agents may be added to the polymer latices so as to control the viscosity of the latexes and thereby achieve the proper flow properties for the particular application desired.

The polyolefin nonwovens are generally sold in bat form which are made of fibers about 1 to 2 inches long and weigh about 0.2 to 20 ounces per square yard. The polyolefin nonwovens theoretically include a large number of materials, however, only polyethylene and polypropylene are of commercial interest presently.

A latex of a water-insoluble homopolymer or copolymer of the present invention may be applied to the web or mat of fibers in any suitable fashion such as by spraying, dipping, roll-transfer, or the like. Application of the latex to the fibers is preferably made at room temperature to facilitate cleaning of the associated apparatus. The solids concentration of the latex is in the range of 5% to 60% by weight, and preferably from 5% to 25% when applied by dipping. When applied by roll-transfer, solids concentration of the latex is generally about 50% whereas with the spraying technique, it can range widely.

An acid catalyst is preferably included in the latex at the time it is applied to the fibrous web or it may be applied to the fibrous web before or after the latex is applied. Examples of acidic catalysts that may be employed include oxalic acid, dichloracetic acid, p-toluenesulfonic acid, and acrylic salts such as ammonium sulfate, and amine salts such as the hydrochloride of 2-methyl-2-aminopropanol-1.

The proportion of the latex polymer that is applied to the web or mat is such as to provide 15 to 100% by weight of the polymer, based on the total weight of the polymer and fibers. After application of the latex to the fibrous web, the impregnated or saturated web is dried either at room temperature or at elevated temperature. The web is subjected, either after completion of the drying or as the final portion of the drying stage itself, to a baking or curing operation which may be effected at a temperature of about 210° to about 750° F. for a period which may range from about one-half hour at the lower temperatures to as low as five seconds at the upper temperatures. The conditions of baking and curing are controlled so that no appreciable deterioration or degradation of the fibers or polymer occurs. Preferably, the curing is effected at a temperature of 250° to 325° F. for a period of 2 to 10 minutes.

A number of examples are presented herein for the purpose of illustrating the invention directed to the use of binder latexes containing polymerized vinyl chloride or vinylidene chloride to bond polyolefin nonwovens which exhibit unexpectedly higher wet strength retention.

EXAMPLE 1

The latexes used to impregnate polyolefin nonwoven webs were prepared in accordance with the procedure described herein. These latexes have the following composition in parts by weight and are identified by letters A to F:

Latex 1-A—45 VCl/36-2EHA/16$VCl_2$/2AA
Latex 1-B—45 VCl/34-2EHA/16 $VCl_2$/4HMDAA
Latex 1-C—45 VCl/36-2EHA/16 $VCl_2$/2HPMA
Latex 1-D—Latex 1-C at pH 6.5 and 5 phr melamine formaldehyde resin
Latex 1-E—Latex 1-C at pH 6.0 and 5 phr melamine formaldehyde resin
Latex 1-F—Latex 1-A with 5 phr maleic anhydride-vinyl ether polymer The abbreviations used above are identified as follows:
VCl—vinyl chloride
$VCl_2$—vinylidene chloride
2EHA—2-ethylhexyl acrylate
AA—acrylic acid
HMDAA—hydroxymethyl diacetone acrylamide
HPMA—hydroxypropyl methacrylamide Polypropylene nonwoven used in this example was Herculon 1.811X1.5" T-152 White 125 card web with a weight of 0.66 ounce per square yard. The nonwoven web was cut into 8"X14" sheets, saturated with the latex and padded to remove excess latex while in an envelope of Dacron fabric. Twenty pounds air pressure was used on the padder rolls. The sheets were then hung at room temperature to dry. After drying at room temperature, the sheets to be tested at higher cure temperatures were cured for 10 minutes at 275° F. Six samples of 1"X6" were cut lengthwise from one end of the sheet for testing machine direction properties and six samples of 1"X6" were cut crosswise from the sheet starting at the center of the sheet to test cross machine direction properties.

All baths were 25% total solids. The samples were conditioned for 24 hours in a controlled environment of 72° F. and 50% relative humidity and then tested on the Instron machine for tensile strength. The wet samples were aged for 24 hours in distilled water and then tested on the Instron machine. Percent wet strength retention was calculated by dividing wet tensile strength by dry tensile strength and multiplying the result by 100. The tensile strength in pounds per inch was measured in the machine and cross machine directions. Results of these tests are given in Table I, below:

TABLE I

| | Room Temperature Dried | | | | | |
|---|---|---|---|---|---|---|
| | Machine Direction | | | Cross Machine Direction | | |
| Latex | Dry Tensile | Wet Tensile | % Wet Tensile Retention | Dry Tensile | Wet Tensile | % Wet Tensile Retention |
| 1-A | 28 | 11 | 39 | 6.4 | 1.7 | 18 |
| 1-B | 28 | 11 | 38 | 4.5 | 1.2 | 27 |
| 1-C | 26 | 12 | 47 | 3.5 | 1.2 | 34 |
| 1-D | 27 | 9 | 34 | 3.9 | 1.1 | 28 |
| 1-E | 28 | 16 | 58 | 3.4 | 3.3 | 97 |

| | Room Temperature Dried and Cured at 275° F. for 10 Minutes | | | | | |
|---|---|---|---|---|---|---|
| | Machine Direction | | | Cross Machine Direction | | |
| Latex | Dry Tensile | Wet Tensile | % Wet Tensile Retention | Dry Tensile | Wet Tensile | % Wet Tensile Retention |
| 1-A | 32 | 17 | 52 | 6.8 | 4.0 | 59 |
| 1-B | 28 | 16 | 58 | 5.0 | 2.4 | 48 |
| 1-C | 29 | 26 | 90 | 5.0 | 4.0 | 80 |
| 1-D | 26 | 16 | 64 | 2.9 | 2.9 | 100 |
| 1-E | 28 | 26 | 94 | 1.9 | 1.9 | 100 |
| 1-F | 29 | 31 | 106 | 2.0 | 2.3 | 115 |
| Control - No Latex | 0.2 | 0.2 | — | 0 | 0 | — |

The latexes investigated in this experiment showed wet strength retention varying from a low of 34% to a high of 58% for room temperature dried samples for machine direction testing whereas these values ranged from a low of 18% to a high of 97% when the tensile strength was measured in the cross machine direction. In the machine direction for room temperature drying, percent wet retention varied from a low of 34% for Latex 1-D to a high of 58% for Latex 1-E. Latexes 1-D and 1-E are substantially identical except for pH. With respect to tensile strength tests conducted in the cross machine direction, the lowest wet strength retention figure of 18% was achieved by Latex 1-A whereas the highest figure of 97% was obtained with Latex 1-E.

When the bonded samples were dried and cured for 10 minutes at 275° F., excellent wet strength values were obtained for polypropylene nonwoven webs bonded with heat reactive systems and those bonded with latexes containing vinyl methyl ether-maleic anhydride copolymer as emulsifier in place of an alkali sulfonate surfactant in polymerization. For the machine direction testing of tensile strength, the lowest wet tensile retention of 52% was exhibited by polypropylene nonwoven webs treated with Latex 1-A and the highest wet tensile retention was obtained with Latex 1-F, the same latex that gave the highest wet tensile retention for cross machine direction testing which, additionally, contains a small amount of maleic anhydride-vinyl ether polymer as emulsifier in place of an alkali sulfonate surfactant. The lowest percent wet strength retention in the cross machine direction was 48% registered by Latex 1-B whereas the highest was 115% registered by Latex 1-F.

EXAMPLE 2

Additional tests were made to determine wet tensile retention, pursuant to the procedure described in the previous example, using a number of acrylic latexes and two latexes containing polymerized vinyl chloride. All latexes were adjusted to a pH of 3.0 with citric acid and the nonwoven web was polypropylene of 1.8 denier and 2.8 to 3.2 grams per square foot. The impregnated samples were dried for 3 minutes at 110° C. The method of evaluation consisted of saturating the nonwoven web in a dilute latex bath. The concentration of the bath used was governed by the pick up desired. For most of the work, a 15% total solids bath was used. The nonwoven web was placed between two sheets of thin polyurethane foam which then was placed between two sheets of polymeric screening material. The assembly was submerged in the latex bath. The impregnated nonwoven was then run through the padder at air pressure of 50 psi, removed from the foam sandwich, and then dried on a photoprint dryer at 212° F., usually in about two minutes. The nonwoven web was placed in an air circulating oven for the final cure whereby a cured nonwoven fabric was formed. Wet tensile strength was determined after soaking samples for 16 to 20 hours in a 1% Aerosol OT in distilled water solution. Aerosol OT is sodium dioctyl sulfosuccinate. Results of dry and wet tensile strength tests, as well as percent wet strength retention, are given in Table II, below, where the following latexes are referred to:

Latex 2-A is essentially ethyl acrylate copolymerized with small amounts of vinyl cyanide, N-methylol acrylamide and acrylic acid.

Latex 2-B is a copolymer of ethyl acrylate and n-butyl acrylate with small amounts of vinyl cyanide, N-methylol acrylamide and acrylamide.

Latex 2-C is essentially polyethyl acrylate copolymerized with small amounts of vinyl cyanide, acrylamide and N-methylol acrylamide.

Latex 2-D is same as Latex 2-C with non-ionic phosphate soap.

Latex 2-E is essentially poly-n-butyl acrylate copolymerized with small amounts of vinyl cyanide, acrylamide, and N-methylol acrylamide.

Latex 2-F is a polymer of ethyl acrylate with small amounts of N-methylol acrylamide and acrylic acid copolymerized therewith.

Latex 2-G is FDA approved Latex 2-A.

Latex 2-H is essentially polyethyl acrylate copolymerized with a small amount of N-methylol acrylamide.

Latex 2-I is essentially polyethyl acrylate copolymerized with small amounts of methyl methacrylate, acrylamide and N-methylol acrylamide.

Latex 2-J is a copolymer of ethyl acrylate and n-butyl acrylate with a small amount of N-methylol acrylamide.

Latex 2-K is a copolymer of ethyl acrylate, n-butyl acrylate and a small amount of acrylamide.

Latex 2-L is plasticized copolymer of a major proportion of vinyl chloride and methyl acrylate.

Latex 2-M is a copolymer of a major proportion of n-butyl acrylate, and small amounts of vinyl chloride, acrylic acid and N-methylol acrylamide.

TABLE II

| Latex | % Pick Up | Dry Tensile | Wet Tensile | % Wet Tensile Retention |
|---|---|---|---|---|
| 2-A | 12 | 10 | 0.4 | 46 |
| 2-A | 21 | 2.2 | 0.6 | 29 |
| 2-B | 15 | 0.9 | 0.2 | 26 |
| 2-B | 26 | 4.1 | 0.2 | 6 |
| 2-B | 60 | 6.3 | 0.8 | 13 |
| 2-C | 15 | 1.3 | 0.3 | 25 |
| 2-D | 23 | 2.1 | 0.5 | 23 |
| 2-E | 16 | 3.0 | 0.2 | 7 |
| 2-F | 33 | 2.2 | 0.2 | 11 |
| 2-G | 13 | 1.4 | 0.1 | 7 |
| 2-H | 12 | 1.0 | 0.1 | 10 |
| 2-I | 15 | 1.5 | 0.1 | 7 |
| 2-J | 16 | 1.3 | 0.4 | 28 |
| 2-K | 16 | 1.1 | 0.2 | 20 |
| 2-K | 20 | 3.6 | 0.4 | 10 |
| | Latexes Containing Polyvinyl Chloride | | | |
| 2-L | 17 | 0.6 | 0.5 | 78 |
| 2-M | 21 | 1.5 | 1.7 | 113 |

Perusal of the date in Table II, above, shows the extraordinary difference in percent wet tensile retention between polypropylene nonwoven web samples bonded with acrylic latexes compared to those bonded with latexes containing polyvinyl chloride. The lowest wet strength retention for the acrylic latexes was 6% exhibited by Latex 2-B, a polymer of ethyl acrylate, n-butyl acrylate with small amounts of vinyl cyanide, N-methylol acrylamide, and acrylamide copolymerized therewith. The highest wet strength retention for the acrylic latexes was 46% shown by Latex 2-A, a polymer of ethyl acrylate with small amounts of vinyl cyanide, N-methylol acrylamide, and acrylic acid copolymerized therein. The range of wet strength retention for acrylic latexes was 6% to 46% whereas for the latexes containing polyvinyl chloride the range was 78% to 113%, a remarkable increase. The low value of 78% wet tensile retention was obtained with Latex 2-L, a plasticized polymer of vinyl chloride and a minor amount of methyl acrylate whereas the high value of 113% was attained with Latex 2-M, a polymer of n-butyl acrylate with a minor proportion of vinyl chloride and small amounts of acrylic acid and N-methylol acrylamide copolymerized therewith. Tensile strength herein is given in pounds per inch units measured in cross machine direction.

EXAMPLE 3

In this experiment, several acrylic latexes and one latex containing polyvinyl chloride were used to bond polyester nonwoven webs, in the manner described in Example 2, in order to compare wet tensile retention of acrylic latexes containing polyvinyl chloride when used as bonding agents on non-polyolefin nonwoven webs. The impregnated polypropylene nonwoven webs were cured for 3 minutes at 230° F. whereas polyester nonwovens were cured for 5 minutes at 300° F. The reason for different curing conditions is that polypropylene would melt at 300° F. Description of the latexes used and results of these tests are given below where tensile strength is in pounds per inch units measured in cross machine direction:

Latex 3-A is an FDA approved polymer of ethyl acrylate with small amounts of vinyl cyanide, N-methylol acrylamide, and acrylic acid copolymerized therewith.

Latex 3-B is polymer of ethyl acrylate with small amounts N-methylol acrylamide and acrylic acid copolymerized therewith.

Latex 3-C is a polymer of ethyl acrylate and a small amount of N-methylol acrylamide.

Latex 3-D is a polymer of ethyl acrylate with small amounts of methyl methacrylate, acrylamide, and N-methylol acrylamide.

Latex 3-E is a polymer of ethyl acrylate with small amounts of N-methylol acrylamide and acrylamide copolymerized therewith.

Latex 3-F is a polymer of ethyl acrylate, n-butyl acrylate, and a small amount of N-methylol acrylamide.

Latex 3-G is a polymer of ethyl acrylate, n-butyl acrylate, and a small amount of acrylamide.

Latex 3-H is a polymer of ethyl acrylate and n-butyl acrylate with small amounts of N-methylol acrylamide and acrylamide polymerized therein prepared with sodium lauryl sulfate.

Latex 3-I is the same polymer as Latex 3-H with exception that linear alkyl sulfonate was used in place of sodium lauryl sulfate.

Latex 3-J is a polymer of n-butyl acrylate and small amounts of vinyl chloride, acrylic acid, and N-methylol acrylamide.

TABLE III

| Latex | % Pick Up | Dry Tensile lbs/in | Wet Tensile | % Wet Tensile Retention |
|---|---|---|---|---|
| 3-A | 24 | 5.0 | 1.8 | 36 |
| 3-B | 20 | 5.2 | 2.8 | 54 |
| 3-C | 21 | 4.0 | 2.0 | 51 |
| 3-D | 16 | 2.6 | 1.6 | 65 |
| 3-E | 14 | 3.2 | 1.4 | 44 |
| 3-F | 12 | 2.2 | 0.8 | 35 |
| 3-G | — | 7.9 | 3.0 | 38 |
| 3-H | 18 | 2.0 | 1.0 | 46 |
| 3-I | 23 | 3.8 | 2.0 | 51 |
| 3-J | 18 | 1.9 | 1.3 | 68 |

The results in Table III, above, demonstrate that polyester nonwoven fabrics exhibit wet tensile retention at about the same level whether bonded with acrylic or vinyl chloride-containing latexes. This conclusion is based on wet tensile retention values ranging from 35% to 65% for acrylic latexes and 68% for the latex containing polyvinyl chloride. Earlier experiments have shown dramatically higher wet tensile retention values for polypropylene nonwoven webs bonded with latexes containing polyvinyl chloride and/or polyvinylidene chloride than with acrylic latexes. These results confirm the synergistic results obtained with respect to wet tensile retention of polyolefin nonwoven webs bonded with latexes containing polyvinyl chloride and/or polyvinylidene chloride.

I claim:

1. A nonwoven fabric having improved wet tensile strength retention comprising polyolefin nonwoven fibers bonded together with a binder selected from the group consisting of latexes containing polyvinyl chloride wherein vinyl chloride is copolymerized with one or more of copolymerizable monomers selected from the group consisting of vinylidene chloride, $\alpha,\beta$-olefinically unsaturated carboxylic acids containing 3 to 5 carbon atoms; monounsaturated dicarboxylic acids containing 4 to 8 carbon atoms; esters of $\alpha,\beta$-olefinically unsaturated monocarboxylic and dicarboxylic acids containing 4 to 20 carbon atoms; acrylamides and methacrylamides and their N-alkylol derivatives containing 3 to 20 carbon atoms selected from the group consisting of hydroxyalkyl diacetone acrylamides and methacrylamides, hydroxyalkyl acrylamides and methacrylamides, N-alkylol acrylamides and methacrylamides, and mixtures thereof; vinyl ethers containing 4 to 22 carbon atoms; vinyl ketones containing 3 to 12 carbon atoms; vinyl esters of carboxylic acids containing 4 to 22 carbon atoms; alpha olefins containing 2 to 12 carbon atoms; styrene and styrene derivatives; and mixtures thereof.

2. A nonwoven fabric of claim 1 wherein said fibers are selected from the group consisting of polyethylene, polypropylene, and mixtures of such fibers; and amount of polymerized vinyl chloride in said latexes is at least about 5% by weight and up to an amount where it represents a major proportion.

3. A nonwoven fabric of claim 2 wherein said binder on said fabric is in a cured condition and amount of polymerized vinyl chloride in said latexes is a minimum of 20% by weight.

4. A method for making nonwoven fabric with improved wet tensile strength retention comprising contacting polyolefin fibers with a binder to adhere said fibers together, said binder is selected from the group consisting of latexes containing polyvinyl chloride wherein vinyl chloride is copolymerized with one or more of copolymerizable monomers selected from the group consisting of vinylidene chloride; $\alpha,\beta$-olefinically unsaturated carboxylic acids containing 3 to 5 carbon atoms; monounsaturated dicarboxylic acids containing 4 to 8 carbon atoms; esters of $\alpha,\beta$-olefinically unsaturated monocarboxylic and dicarboxylic acids containing 4 to 20 carbon atoms; $\alpha,\beta$-olefinically unsaturated nitriles containing 3 to 5 carbon atoms; acrylamides and methacrylamides derived from acrylic and methacrylic acids and their N-alkylol derivatives containing 3 to 20 carbon atoms selected from the group consisting of hydroxyalkyl diacetone acrylamides and methacrylamides, hydroxyalkyl acrylamides and methacrylamides, N-alkylol acrylamides and methacrylamides, and mixtures thereof; vinyl ethers containing 4 to 22 carbon atoms; vinyl esters of carboxylic acids containing 4 to 22 carbon atoms; alpha olefins containing 2 to 12 carbon atoms; styrene and styrene derivatives; and mixtures thereof.

5. A method of claim 4 wherein said fibers are selected from the group consisting of polyethylene, polypropylene, and mixtures thereof; and amount of polymerized vinyl chloride in said latex is a minimum of 20% by weight.

* * * * *